US009223294B2

(12) United States Patent
Ng et al.

(10) Patent No.: US 9,223,294 B2
(45) Date of Patent: Dec. 29, 2015

(54) AUTOMATIC WINDING DEVICE USED FOR AUTOMATIC WINDING WATCH

(71) Applicant: Ming Sang Ng, Hong Kong (HK)

(72) Inventors: Ming Sang Ng, Hong Kong (HK); Kam Wah Soo, Hong Kong (KR)

(73) Assignee: Ming Sang Ng, Hong Kong (HK)

( * ) Notice: Subject to any disclaimer, the term of this patent is extended or adjusted under 35 U.S.C. 154(b) by 0 days.

(21) Appl. No.: 14/517,970

(22) Filed: Oct. 20, 2014

(65) Prior Publication Data

US 2015/0117164 A1 Apr. 30, 2015

(30) Foreign Application Priority Data

Oct. 28, 2013 (HK) ..... 13112084.7

(51) Int. Cl.
*G04D 7/00* (2006.01)
*G04B 5/00* (2006.01)
*G04B 3/00* (2006.01)

(52) U.S. Cl.
CPC ..... *G04D 7/009* (2013.01); *G04B 3/006* (2013.01); *G04B 5/00* (2013.01)

(58) Field of Classification Search
CPC ..... G04B 3/00; G04B 3/006; G04B 5/00; G04B 5/02; G04C 1/00; G04D 7/00; G04D 7/009
See application file for complete search history.

(56) References Cited

U.S. PATENT DOCUMENTS 4,057,958 A * 11/1977 Wuntch ..... 368/207
5,608,693 A * 3/1997 Richards ..... 368/10
5,988,871 A * 11/1999 Bonnet ..... 368/206
6,254,270 B1 * 7/2001 Agnoff ..... 368/206
6,543,929 B1 * 4/2003 Agnoff ..... 368/206
2003/0076748 A1 * 4/2003 Rustioni ..... 368/206
2005/0254352 A1 * 11/2005 Wolf V et al. ..... 368/206
2005/0265129 A1 * 12/2005 Agnoff ..... 368/206
2006/0018199 A1 * 1/2006 Louie ..... 368/206
2007/0097797 A1 * 5/2007 Agnoff ..... 368/206
2007/0159929 A1 * 7/2007 Louie ..... 368/206
2008/0247278 A1 * 10/2008 Walker et al. ..... 368/206
2009/0225632 A1 * 9/2009 Agnoff ..... 368/207

(Continued)

FOREIGN PATENT DOCUMENTS

CN 102887270 A 1/2013
EP 1288744 A1 3/2003

OTHER PUBLICATIONS

Search Report of counterpart Hong Kong Short-term Patent Application No. 13112084.7 issued on Nov. 7, 2013.

*Primary Examiner* — Amy Cohen Johnson
*Assistant Examiner* — Matthew Powell

(57) ABSTRACT

The patent application relates to an automatic winding device used for automatic winding watch, which includes a box body, a rotating seat arranged on the box body and relatively rotatable to the box body, a holding seat fixed on the rotating seat and used for placing the automatic winding watch, a driving mechanism driving the rotating seat to rotate, and a control device controlling the rotating mode of the driving mechanism. The driving mechanism is arranged in the box body. The automatic winding device used for automatic winding watch can be rotatably arranged on the box body through the rotating seat. The watch is sheathed on the holding seat and then placed on the rotating seat. Compared with the existing rotation in a rotating cavity, the patent application reduces the noise, and is beneficial for displaying the watch.

15 Claims, 6 Drawing Sheets

(56) References Cited

U.S. PATENT DOCUMENTS

2010/0165798 A1* 7/2010 Huang ..... 368/206
2010/0165799 A1* 7/2010 Huang ..... 368/210
2011/0026374 A1* 2/2011 Chang ..... 368/206
2011/0170380 A1* 7/2011 Moroni et al. ..... 368/206

* cited by examiner

AUTOMATIC WINDING DEVICE USED FOR AUTOMATIC WINDING WATCH

CROSS-REFERENCE TO RELATED APPLICATIONS

This application claims priority of Hong Kong patent application No. 13112084.7 filed on Oct. 28, 2013, the entire content of which is hereby incorporated by reference.

TECHNICAL FIELD

The patent application relates to a winding device, and in particular, to an automatic winding device used for automatic winding watch.

BACKGROUND

An automatic winding watch (mechanical watch) drives a hour hand and a minute hand therein to run through an internal winding mechanism. The winding principle of the winding mechanism is to employ an eccentric rotor and utilize a gravity effect as well as the oscillating or winding of an arm of a user while wearing to rotate, so as to drive gears to wind up a mainspring to realize winding. The energy for winding the watch can be stored in the winding mechanism, and can maintain the watch to run for at least 24 hours. In the case that the automatic winding watch is not worn, the energy stored therein is gradually consumed till it is used up, and the watch stops running then there is no driving force. When wearing the watch again, it needs to re-wind the watch, which is inconvenient to use.

In order to make the automatic winding watch still work continuously in the case of being not worn, a winding device for watch appears in the market, for winding the watch in the case of displaying the watch or in the case that the user does not wear the watch. The winding device on the present market comprises a hollow bowl-shaped or drum-shaped rotating cavity and a sheathing mechanism used for sheathing the automatic winding watch. The sheathing mechanism is contained in the rotating cavity. The rotating cavity is driven by a motor to rotate along an axis thereof so as to drive the watch to rotate, thereby winding the watch. However, the noise generated by the motor in the existing winding device during the rotating process is amplified by the rotating cavity, thus increasing the noise. Furthermore, the arrangement of the rotating cavity makes a watch band of the watch be hidden therein, which is not beneficial for displaying.

SUMMARY

A technical problem to be solved by the patent application is to provide an automatic winding device used for automatic winding watch, which can wind the automatic winding watch in the case that the automatic winding watch is not worn.

To solve the technical problem, the patent application employs a technical solution as follows: the patent application provides an automatic winding device used for an automatic winding watch, which comprises a box body, a rotating seat arranged on the box body and relatively rotatable to the box body, a holding seat fixed on the rotating seat and used for placing the automatic winding watch, a driving mechanism driving the rotating seat to rotate, and a control device controlling the rotating mode of the driving mechanism, wherein the driving mechanism is arranged in the box body.

In the automatic winding device used for automatic winding watch according to the patent application, the holding seat comprises a U-shaped framework and a flexible mandrel arranged in the framework for sheathing the automatic winding watch. Two relative side plates of the framework are respectively formed with an elastic locking arm used for fixing the holding seat on the rotating seat.

In the automatic winding device used for automatic winding watch according to the patent application, the tail end of the elastic locking arm towards the rotating seat is provided with a clamping bolt. The rotating seat is provided with a clamping groove matched with the clamping bolt.

In the automatic winding device used for automatic winding watch according to the patent application, the rotating seat is circular, and the clamping groove is arranged on the internal side surface of the rotating seat. Or, the rotating seat is tabular, and the clamping groove is arranged on the surface of the rotating seat facing to the holding seat.

In the automatic winding device used for automatic winding watch according to the patent application, the control device comprises a control unit, an optical sensor used for inducing the rotational velocity and rotation angle of the driving mechanism, a random number generation module for generating random parameters, a pulse duration modulation module matched with the random parameter generation module so as to generate a corresponding random rotating mode, and an H bridge driving circuitry. The optical sensor, the random parameter generation module, the pulse duration modulation module and the H bridge driving circuitry are all electrically connected with the control unit.

In the automatic winding device used for automatic winding watch according to the patent application, the driving mechanism comprises a motor and a transmission case connected between the motor and the rotating seat. The motor is electrically connected with the control unit through the H bridge driving circuitry.

In the automatic winding device used for automatic winding watch according to the patent application, the transmission case comprises an input gear connected with the motor, a first gear engaged with the input gear, an output gear, a plurality of second gears engaged between the first gear and the output gear in sequence, and a detection gear engaged with the first gear. The optical sensor is matched with the detection gear. The transmission case is fixedly connected with the rotating seat through the output gear. The bottom of the rotating seat is provided with a joint pin stretching into the box body and connected with the output gear. A bearing support corresponding to the joint pin is arranged in the box body.

In the automatic winding device used for automatic winding watch according to the patent application, the box body is further provided with a power indicator light. The power indicator light is electrically connected with the control unit.

In the automatic winding device used for automatic winding watch according to the patent application, a plurality of uniformly-spaced through holes are arranged on the detection gear, encircling the central axis of the detection gear. Infrared light beams of the optical sensor are alternatively irradiated on the detection gear through the through holes during the rotating process of the detection gear.

In the automatic winding device used for automatic winding watch according to the patent application, the automatic winding device further comprises a box cover. The box cover is covered on the box body to shield the rotating seat and the holding seat between the box body and the box cover. The box body is a sealed box body.

The advantageous effects to implement the patent application are as follows: the automatic winding watch is easy to hold and disassemble; the automatic winding device used for automatic winding watch can be rotatably arranged on the box body through the rotating seat; compared with the existing rotation in a rotating cavity, the patent application reduces the noise, and is beneficial for displaying the watch; the watch is sheathed on the holding seat and then placed on the rotating seat; with the rotation of the rotating seat, the automatic winding device used for an automatic winding watch can simulate the swinging of a human arm to wind the watch, so that the watch still keeps enough power to run normally in the case of being not worn.

BRIEF DESCRIPTION OF DRAWINGS

The patent application will be further described hereinafter with reference to the drawings and embodiments, in the drawings.

DETAILED DESCRIPTION

Figure 1:
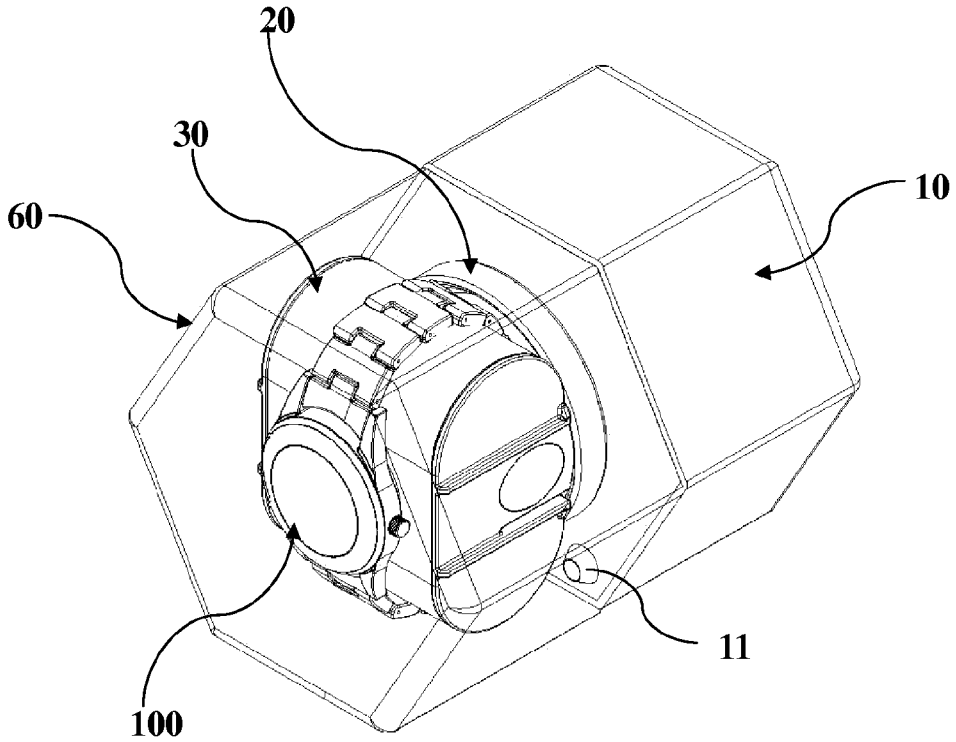
FIG. 1 is a perspective view of an automatic winding device used for automatic watch according to an embodiment of the patent application.
Figure 7:
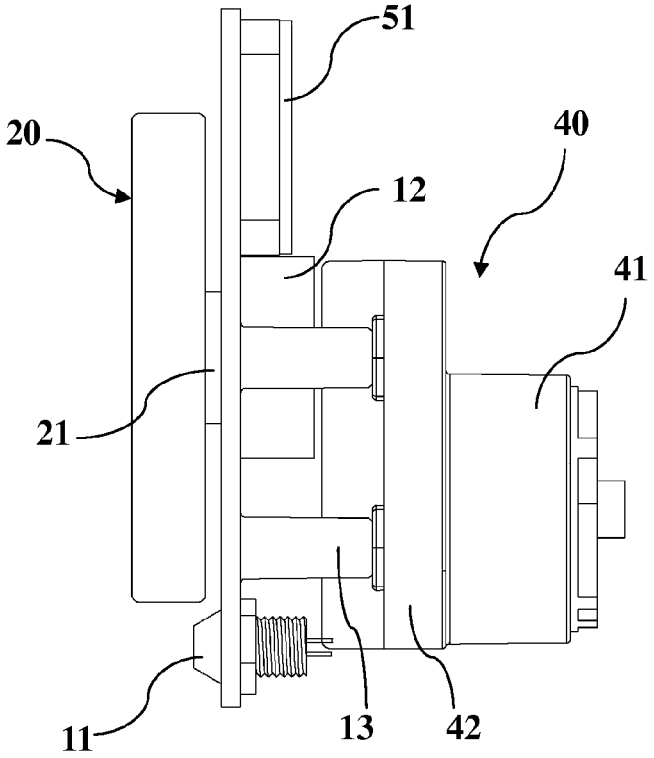
FIG. 7 is an internal structure schematic view of the box body in FIG. 1.

As shown in FIG. 1 and FIG. 7, an automatic winding device used for automatic watch according to an embodiment of the patent application comprises a box body 10, a rotating seat 20, a holding seat 30, a driving mechanism 40 and a control device. The rotating seat 20 is arranged on the box body 10 and can rotate relatively to the box body 10. The holding seat 30 is used for holding the automatic winding watch 100. The holding seat 30 is fixed on the rotating seat 20 so as to rotate with the rotating seat 20. The driving mechanism 40 is used for driving the rotating seat 20 to rotate. The control device is then used for controlling the rotating mode of the driving mechanism 40. The automatic winding device controls the driving mechanism 40 to work through the control device, thus driving the rotating seat 20 to rotate, so as to drive the holding seat 30 and the automatic winding watch 100 thereon to rotate according to a required rotating mode. The rotating mode is mainly based on simulating the swinging of a human arm, comprising such modes as rotating at a random rotational velocity, rotating with a random rotation angle, rotating in a random rotation direction (clockwise or anticlockwise), rotating in a random continuing rotation time, and a random suspended rotating time, and the like. During the running process, an eccentric rotor in the automatic winding watch 100 is utilized to automatically wind the watch under a gravity force.

Figure 2:
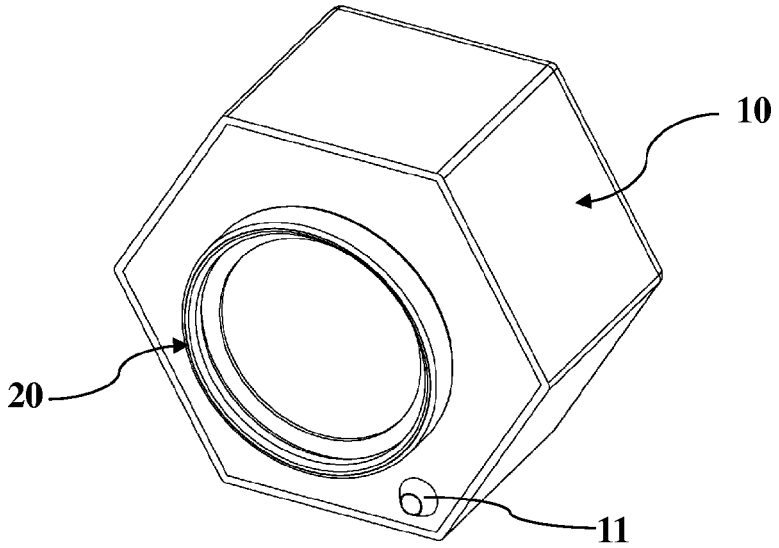
FIG. 2 is a structure schematic view of a box body and a rotating seat in FIG. 1.
Figure 3:
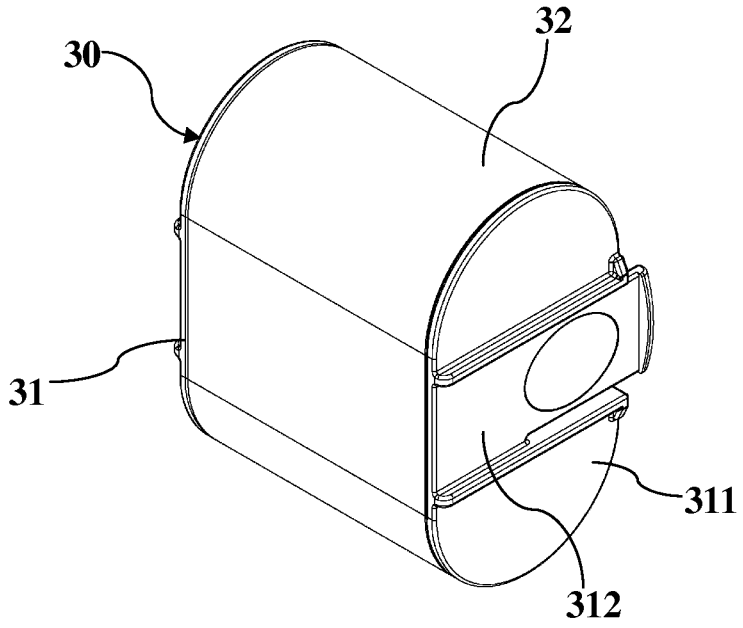
FIG. 3 is a structure schematic view of a holding seat in FIG. 1.
Figure 4:
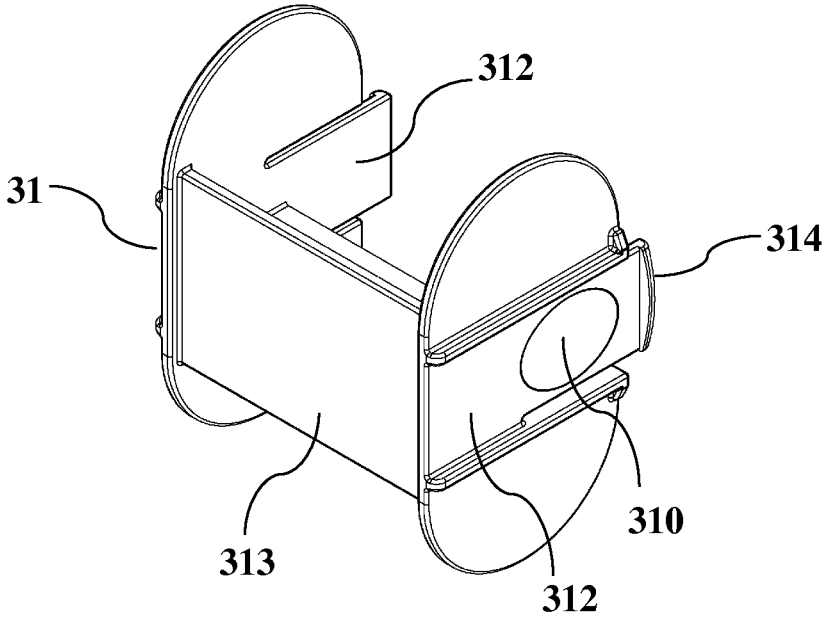
FIG. 4 is a structure schematic view of a framework in FIG. 3.
Figure 5:
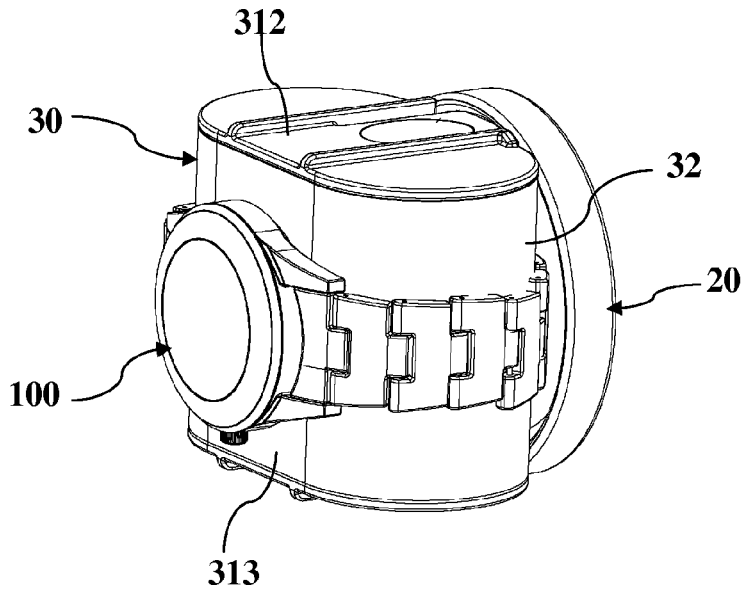
FIG. 5 is a structure schematic view of the rotating seat, the holding seat and an automatic winding watch in FIG. 1.
Figure 6:
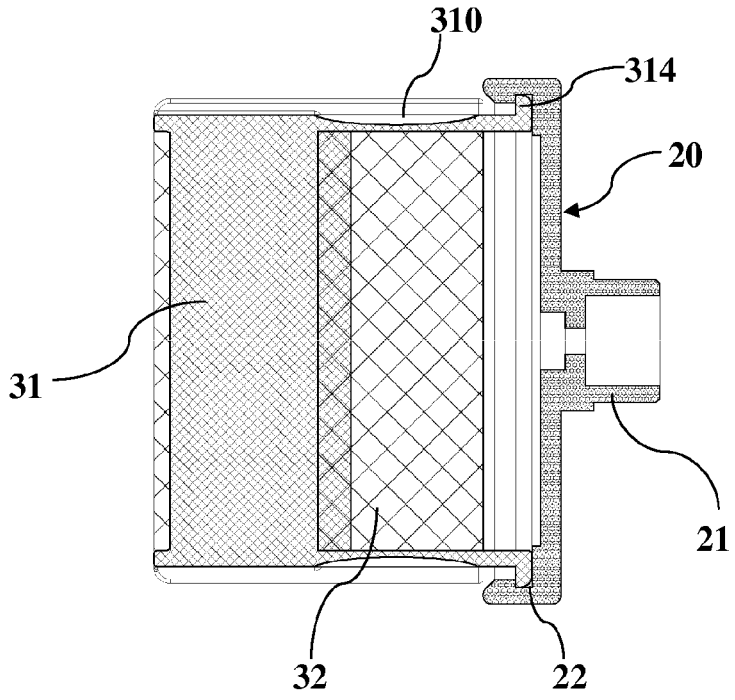
FIG. 6 is a sectional view of a holding seat in FIG. 5.

As shown in FIG. 2, the box body 10 is a hollow structure so as to hold the driving mechanism 40. Moreover, the box body 10 is a sealed box body preferably, which can prevent the noise produced during the working of the driving mechanism 40 from being transferred out, and reduce the noise of the automatic winding device. Materials and shapes of the box body 10 are not defined. The materials can be lumber, plastic or metal and the like, and the shapes can be polygon, round and the like, which can be arranged according to the demands. The rotating seat 20 is arranged on the box body 10. The bottom of the rotating seat stretches into the box body 10 and is connected with the driving mechanism in the box body 10 through arranging a joint pin 21. Similarly, materials and shapes of the rotating seat 20 are not defined. The materials can be lumber, plastic or metal and the like, and the shapes can be polygon, round and the like, which can be arranged according to the demands. Moreover, the rotating seat 20 can be circular or tubular.

The box body 10 is further provided with a power indicator light 11. The power indicator light 11 is electrically connected with the control device. The power indicator light 11 can have lighting modes of different colors, for example, when the automatic winding device is running, the light is green. When the power supply of the automatic winding device is insufficient, the light is red. Therefore, the control device can be provided with a dimming driving module accordingly so as to drive the lighting mode of the power indicator light 11. In order to reduce the power consumption of the power indicator light 11, the power indicator light can be controlled by the dimming driving module to light flickeringly. When the automatic winding device is running, the power indicator light 11 is primarily green, and then gradually turns to dark so as to save the power consumption of lighting. The power indicator light can flicker in every five seconds or above to display the running state of the device.

As shown in FIG. 2-6, the holding seat 30 is fixed on the rotating seat 20 and driven by the rotating seat 20 to rotate. The holding seat 30 is bowl-shaped or drum-shaped. In the embodiment, the holding seat 30 can be fixed on the rotating seat 20 in a detachable way. The holding seat 30 can comprise a U-shaped framework 31 and a flexible mandrel 32 arranged in the framework 31. The automatic winding watch 100 can be sheathed on the flexible mandrel 32. Two relative side plates 311 of the framework 31 are respectively formed with an elastic locking arm 312 used for fixing the holding seat 30 on the rotating seat 20. The distance between the two elastic locking arms 312 is or larger than the width or diameter of the corresponding position of the rotating seat 20. When the automatic winding watch 100 is sheathed on the holding seat 30, a watch dial of the watch 100 is arranged on a panel 313 between the two side plates 311 of the framework 31, while a watch band is twisted on the flexible mandrel 32 between the two side plates 311. The arrangement of the flexible mandrel 32 makes the holding seat 30 be applicable for sheathing the watch 100 having the watch band of different lengths.

Preferably, the tail end of the elastic locking arm 312 towards the rotating seat 20 is provided with a clamping bolt 314. The rotating seat 20 is provided with a clamping groove 22 matched with the clamping bolt 314. When the rotating seat 20 is circular, the clamping groove 22 is arranged on the internal side surface of the rotating seat 20. When the rotating seat 20 is tabular, the clamping groove 22 is arranged on the surface of the rotating seat 20 facing to the holding seat 30. The flexible mandrel 32 is made of elastic materials such as foam material, sponge and the like. The outside of the flexible mandrel 32 can further be coated with a flexible material layer such as a woven fabric or leather and the like, to enhance the blazonry and grade of the holding seat 30. The framework 31 is made of rigid materials, such as plastic, sheetmetal and the like, has certain elasticity and toughness, and can be bent so as to be not easily fractured.

When the holding seat 30 is fixed on the rotating seat 20, the elastic locking arms 312 at the two sides of the framework 31 are pressed towards the inside of the framework 31. When the two elastic locking arms 312 are pressed towards the inside, the flexible mandrel 32 is also pressed. The clamping bolt 314 of the elastic locking arm 312 is aligned with the clamping groove 22 of the rotating seat 20 and then clamped therein. The pressing of the elastic locking arm 314 is released, and the flexible mandrel 32 extends to a primary state, while after the elastic locking arm 312 restores to a primary position, the clamping bolt 314 thereof is stably clamped in the clamping groove 22 of the rotating seat 20, thus finishing the fixation of the holding seat 30 on the rotating seat 20. During disassembling, the elastic locking arm 312 is pressed towards the inside similarly so that the clamping bolt 314 breaks away from the clamping bolt 22; in this way, the holding seat 30 can be taken down from the rotating seat 20; therefore, operation is convenient. The extendable elasticity effect of the flexible mandrel 32 after being compressed can help the elastic locking arm 312 to recovery, and can make the elastic locking arm 312 to be more stably clamped with the rotating seat 20, and not easily broken away.

Further, concave limiting grooves 310 can be respectively arranged on the side surfaces of the two elastic locking arms 312, which are convenient for fingers to be aligned in the limiting grooves 310, to press the elastic locking arms 312 and control the clamping bolts 314 to be clamped with or broken away from the clamping grooves 22.

As further shown in FIG. 1, the automatic winding device can further comprise a box cover 60. The box cover 60 is covered on the box body 10 to shield the rotating seat 20 and the holding seat 30 between the box body 10 and the box cover 60, thus being capable of protecting the rotating seat 20, the holding seat 30 and the automatic winding watch 100 and the like, and can prevent dust. The box cover 60 can be a transparent box cover made of a transparent material. In this way, even if the box cover 60 is covered on the box body 10, the situations of the rotating seat 20 and the automatic winding watch 100 and the like arranged therein can be still seen clearly. Certainly, the box cover 60 can also be a nontransparent box cover made of a nontransparent material, thus avoiding that the situations of the rotating seat 20 and the automatic winding watch 100 and the like between the box cover and the box body 10 are visible.

Figure 8:
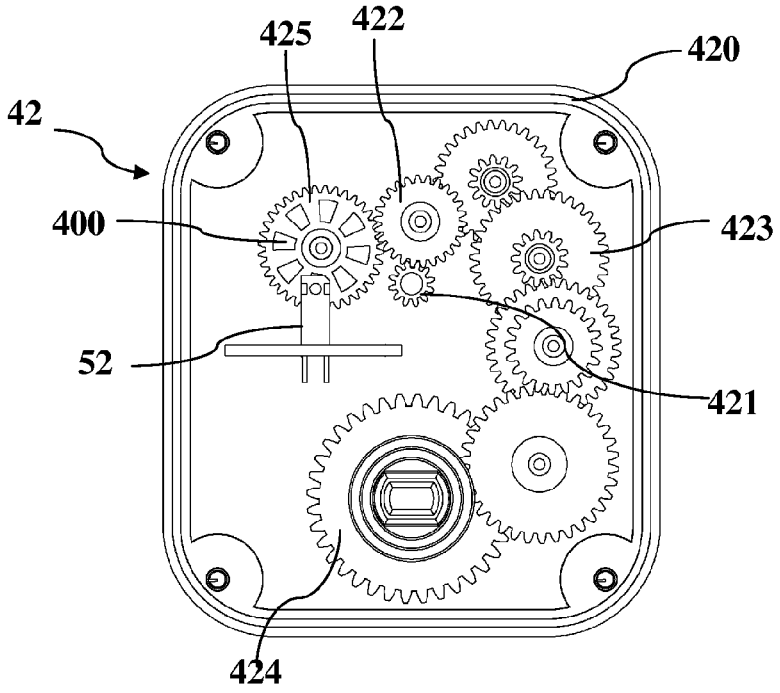
FIG. 8 is a structure schematic view of a transmission case in FIG. 7.

As shown in FIG. 7 and FIG. 8, the driving mechanism 40 comprises a motor 41 and a transmission case 42 connected between the motor 41 and the rotating seat 20. The motor 41 is electrically connected with the control device. The power indicator light 11 is electrically connected with the control device. A dimming driving module is arranged on the control unit. The transmission case 42 comprises an input gear 421 connected with the motor 41, a first gear 422 engaged with the input gear 421, an output gear 424, and a plurality of second gears 423 engaged between the first gear 422 and the output gear 424 in sequence. The transmission case 42 is fixedly connected with the rotating seat 20 through the output gear 424. The bottom of the rotating seat 20 is provided with a joint pin 21. The joint pin 21 stretches into the box body 10 and is connected with the output gear 424. Moreover, the inside of the box body 10 is provided with a bearing support 12 corresponding to the joint pin 21. The bearing support 12 is used for installing a bearing, wherein two bearings are preferred; in this way, the rotating seat 20 stably rotates on the box body 10 without rocking.

In the transmission case 42, the motor 41 having the characteristics of normal high speed/low torque can be converted into the motor 41 having the characteristics of low speed/high torque motor 41 through the arrangement of the first gear 422 and the plurality of second gears 423, and the rotating seat 20 is driven to rotate through the output gear 424. As shown in FIG. 8, and in the embodiment, the transmission case 42 comprises four second gears 423. The control device controls the motor 41 to rotate at a rotational velocity to drive the input gear 421 to rotate, drives the four second gears 423 to rotate in sequence through the first gear 422, and finally drives the output gear 424 to rotate. The rotational velocity is gradually reduced after passing through the first gear 422 and the four second gears 423, so that the final rotational velocity of the output gear 424 is preferably 4-9 revolutions/minute (RPM).

With reference to FIG. 7 and FIG. 8, the transmission case 42 can also comprise a shell 420. The input gear 421, the first gear 422, the plurality of second gears 423 and the output gear 424 are all installed in the shell 420. The shell 420 can be connected in the box body 10 through a plurality of erection columns 13.

Figure 9:
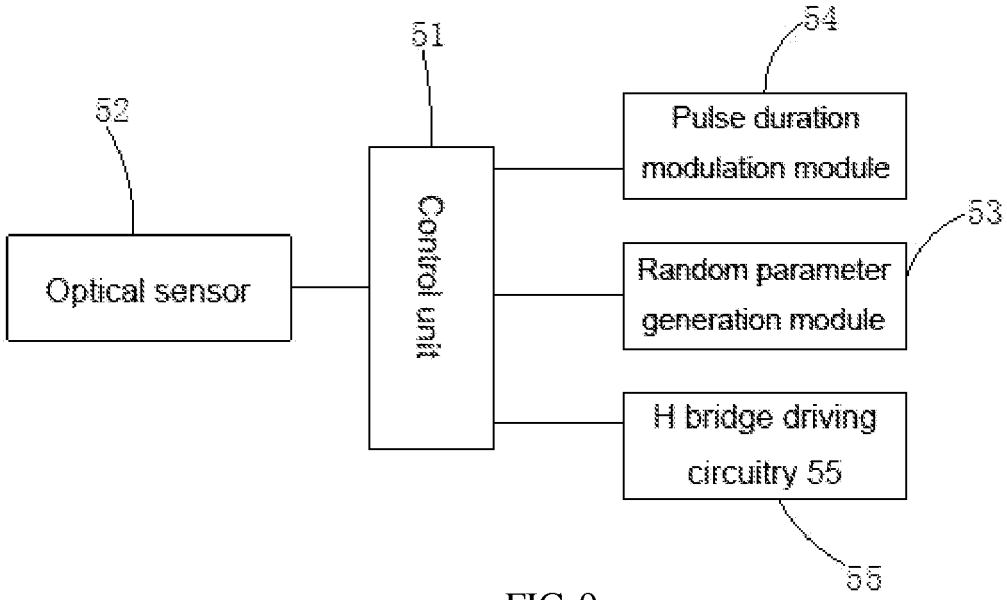
FIG. 9 is a schematic view of a module of a control device according to an embodiment of the patent application.

As shown in FIG. 9, and with reference to FIG. 7 and FIG. 8, the control device comprises a control unit 51, an optical sensor 52 used for inducing the rotational velocity and rotation angle of the driving mechanism, a random number generation module 53 for generating random parameters, a pulse duration modulation module 54 (pulse duration modulation (PWM)) matched with the random parameter generation module 53 so as to generate a corresponding random rotating mode, and an H bridge driving circuitry 55. The optical sensor 52, the random parameter generation module 53, the pulse duration modulation module 54 and the H bridge driving circuitry 55 are all electrically connected with the control unit 51. Moreover, the random parameter generation module 53, the pulse duration modulation module 54 and the H bridge driving circuitry 55 can all be arranged on the control unit 51. In the embodiment, the control device is arranged in the box body 10. The random parameter generation module 53 generates random parameters and generates a corresponding random rotating mode with reference to the pulse duration modulation module 54. The H bridge driving circuitry 55 controls the random rotation direction of the motor 41 according to a corresponding signal of the pulse duration modulation module 54, so that the motor 41 rotates according to the random rotating mode. The rotating mode comprises such modes as rotating at a random rotational velocity, rotating with a random rotation angle, rotating in a random rotation direction, rotating in a random continuing rotation time, and a random suspended rotating time, and the like. The random rotational velocity is no lower than 4 revolutions/minute, and is preferably 4-9 revolutions/minute. The random rotation angle is not smaller than 90 degrees. The rotation direction is clockwise or anticlockwise; moreover, the total revolutions on the clockwise direction are not smaller than 700, and the total revolutions on the anticlockwise direction are similarly not smaller than 700. The continuing rotating time is not less than 15 seconds, and the suspended rotating time does not exceed 10 seconds. Various rotating modes of the driving mechanism are circularly operated in every 24 hours. The plurality of random rotating modes enable the winding manner of the automatic winding device on the automatic winding watch 100 to simulate the swinging manner of a human arm, and enables the winding manner diversified and personalized.

The power indicator light 11 is also connected with the pulse duration modulation module 54 through the control unit 51, and control the voltage volume of the power supply applied to the power indicator light 11 through a pulse duration modulation technology, which can realize such modes that the luminous intensity of the power indicator light 11 is increased from small to big and decrease from big to small, and the like.

The transmission case 42 also comprises a detection gear 425 engaged with the first gear 422. The optical sensor 52 mainly senses the rotational velocity and rotation direction of the detection gear 425. The optical sensor 52 is matched with the detection gear 425, so that the light beams of the optical sensor 52 irradiate towards the direction of the detection gear 425. The optical sensor 52 is electrically connected with the H bridge driving circuitry 55 through the control unit 51. The H bridge driving circuitry 55 controls the rotation direction of the motor 41 according to a signal of the pulse duration modulation module 54. The motor 41 drives each gear in the transmission case 42 to rotate. Meanwhile, the detection gear 425 also rotates, and is sensed by the optical sensor 52 during the rotating process. Moreover, the signal sensed is fed back to the control unit 51. The rotation situation of the output gear 424 is detected through the detection gear 425, i.e. the rotational velocity and rotation angle of the output gear 424 can be obtained through the rotational velocity and rotation angle of the detection gear 425. The detection gear 425 and the output gear 424 are linked and engaged through the first gear 422 and the plurality of second gears 423. The detection gear 425 is arranged capable of detecting that the rotation angle of the output gear 424 is smaller than 1 degree.

The optical sensor 52 is preferably an infrared sensor, senses the rotational velocity and angle of the detection gear 425 through emitting infrared light beams onto the detection gear 425, and generates a corresponding signal and feeds the signal back to the control unit 51. The control unit 51 can determine the actual rotational velocity and angle of the input gear 424 through processing the received feedback signal. A plurality of uniformly-spaced through holes 400 are arranged on the detection gear 425, encircling the central axis of the detection gear 425. Infrared light beams of the optical sensor 52 are alternatively irradiated on the detection gear 425 through the through holes 400 during the rotating process of the detection gear 425. When the infrared light beams are irradiated to the through holes 400, the infrared light beams are not irradiated on to the detection gear 425 through the through holes 400.

Figure 10:
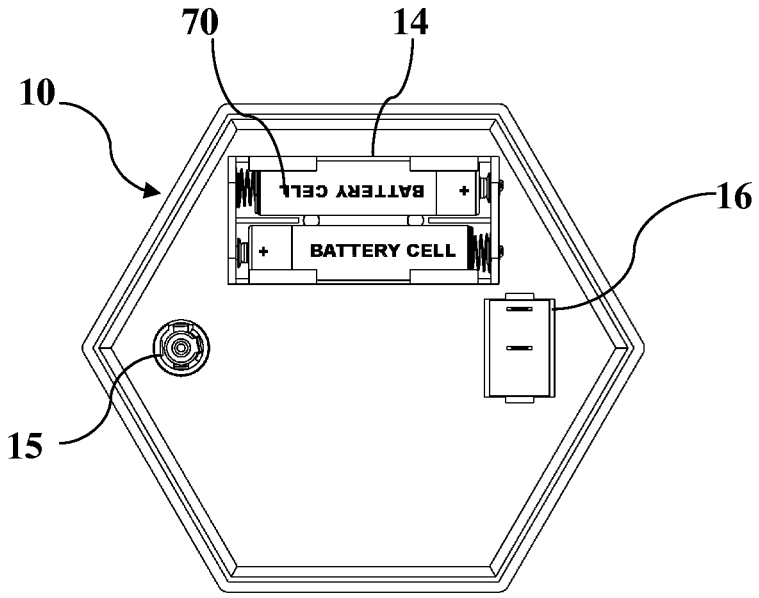
FIG. 10 is a structure schematic view of the bottom of the box body in FIG. 1.

The automatic winding device can employ such modes as battery, electronic or directly external power supply and the like to supply power and run. In the embodiment, as shown in FIG. 10 and with reference to FIG. 7, a battery room 14 used for accommodating a battery 70 is arranged on the side surface or bottom of the box body 10. The battery room 14 is electrically connected with the control unit 51. A dry battery or a rechargeable battery can be employed as the battery 70, and the rechargeable battery is preferred. Accordingly, the box body 10 is further provided with a power socket 15 connected with the battery room 14, for a power line to be spiced with an external power supply and charge the rechargeable battery. The box body 10 is also provided with an on-off key electrically connected with the control unit 51, used for connecting or disconnecting the power supply.

Figure 11:
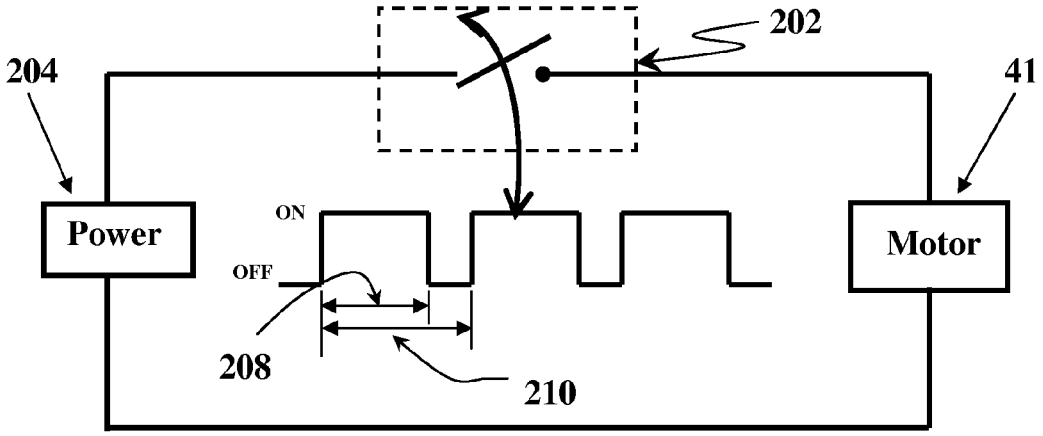
FIG. 11 is a circuit diagram of pulse duration modulation control according to the patent application.

The control unit 51 of the control device applies a voltage onto the motor 41 through the pulse duration modulation module 54 so as to control the rotational velocity of the motor 41. As shown in FIG. 11, the voltage is applied to the motor 41 through the pulse duration modulation module 54 with one time period 210, wherein 208 is a time period for switching on the voltage, and the voltage is applied to the motor 41 by switching on and off the power supply 204 through a switch 202. Because the rotational velocity of the motor 41 depends on the voltage level of the power supply 204 and the self load of the motor 41, closed-loop velocity control of an electrode 41 is realized through detecting the voltage level of the power supply 204 and the signal feedback time for the optical sensor 52 to sense the position between the detection gear 425 and the through holes 400.

Figure 12:
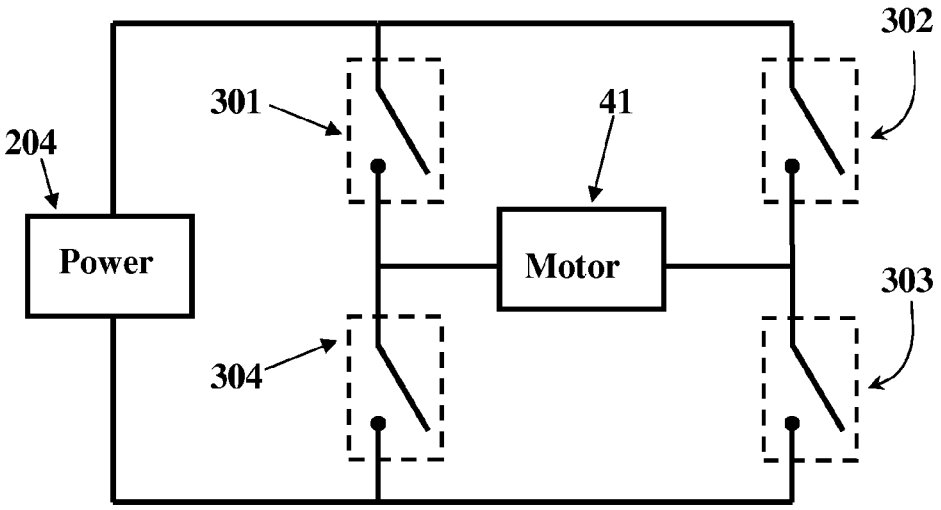
FIG. 12 is a circuit diagram of a control motor of an H bridge driving circuitry according to an embodiment of the patent application.

As a preferred embodiment, and as shown in FIG. 12, the control device controls the rotation direction of the motor 41 through the H bridge driving circuitry 55. The switch 202 comprises a first switch 302, a second switch 302, a third switch 303 and a fourth switch 304. When the first switch 301 and the third switch 303 are switched on, the voltage of the power supply 204 is applied to the motor 41 through the first switch 301 and the third switch 303, to control the motor 41 to rotate in a specific direction (for example, clockwise or anticlockwise); while when the second switch 302 and the fourth switch 304 are switched on, the voltage of the power supply 204 is applied to the motor 41 through the second switch 302 and the fourth switch 304, to control the motor 41 to rotate in an opposite direction (for example, anticlockwise or clockwise), thus realizing the control of the rotation direction of the motor 41.

The foregoing descriptions are merely preferred embodiments of the patent application, and the protection scope of the patent application are not limited by the foregoing embodiments. All technical solution under the concept of the patent application shall all fall within the protection scope of the patent application. It should be pointed out that, a plurality of improvements and polishing figured out by those having ordinary skill in the technical field under the premise of not departing from the principle of the patent application shall also be deemed as the protection scope of the patent application.

The invention claimed is:

1. An automatic winding device used for automatic winding watch, comprising a box body, a rotating seat arranged on the box body and relatively rotatable to the box body, a holding seat fixed on the rotating seat and used for placing the automatic winding watch, a driving mechanism driving the rotating seat to rotate, and a control device controlling a rotating mode of the driving mechanism, wherein the driving mechanism is arranged in the box body;

the control device comprises a random number generation module for generating random parameters, a pulse duration modulation module matched with the random number generation module so as to generate the rotating mode, and a driving circuitry; wherein the rotating mode is a random rotating mode corresponding to one of the random parameters, and the driving circuitry controls the driving mechanism to rotate according to the random rotating mode;

wherein the holding seat comprises a U-shaped framework and a flexible mandrel arranged in the framework for sheathing the automatic winding watch; and two relative side plates of the framework are respectively formed with an elastic locking arm used for fixing the holding seat on the rotating seat;

wherein the tail end of the elastic locking arm towards the rotating seat is provided with a clamping bolt; and the rotating seat is provided with a clamping groove matched with the clamping bolt.

2. The automatic winding device used for automatic winding watch according to claim 1, wherein the rotating seat is circular, and the clamping groove is arranged on the internal side surface of the rotating seat; or, the rotating seat is tabular, and the clamping groove is arranged on the surface of the rotating seat facing to the holding seat.

3. The automatic winding device used for automatic winding watch according to claim 1, wherein the control device also comprises a control unit, and an optical sensor used for inducing a rotational velocity and a rotation angle of the driving mechanism, wherein the optical sensor, the random number generation module, the pulse duration modulation module and the driving circuitry are all electrically connected with the control unit.

4. The automatic winding device used for automatic winding watch according to claim 3, wherein the driving mechanism comprises a motor and a transmission case connected between the motor and the rotating seat, and the motor is electrically connected with the control unit through the driving circuitry.

5. The automatic winding device used for automatic winding watch according to claim 4, wherein the transmission case comprises an input gear connected with the motor, a first gear engaged with the input gear, an output gear, and a plurality of second gears engaged between the first gear and the output gear in sequence; the transmission case is fixedly connected with the rotating seat through the output gear; the bottom of the rotating seat is provided with a joint pin stretching into the box body and connected with the output gear, and a bearing support corresponding to the joint pin is arranged in the box body.

6. The automatic winding device used for automatic winding watch according to claim 5, wherein the transmission case also comprises a detection gear engaged with the first gear, and the optical sensor is matched with the detection gear.

7. The automatic winding device used for automatic winding watch according to claim 6, wherein a plurality of uniformly-spaced through holes are arranged on the detection gear, encircling the central axis of the detection gear; infrared light beams of the optical sensor are alternatively irradiated on the detection gear or to the through holes during the rotating process of the detection gear.

8. The automatic winding device used for automatic winding watch according to claim 7, wherein the rotational velocity of the motor is under closed-loop control through detecting a voltage level provided to the motor and a signal feedback time of the optical sensor to sense a position between the detection gear and the through holes.

9. The automatic winding device used for automatic winding watch according to claim 3, wherein the box body is further provided with a power indicator light, and the power indicator light is electrically connected with the control device.

10. The automatic winding device used for automatic winding watch according to claim 9, wherein the automatic winding device further comprises a box cover; the box cover is covered on the box body to shield the rotating seat and the holding seat between the box body and the box cover; and the box body is a sealed box body.

11. An automatic winding device used for automatic winding watch, comprising a box body, a rotating seat arranged on the box body and relatively rotatable to the box body, a holding seat fixed on the rotating seat and used for placing the automatic winding watch, a driving mechanism driving the rotating seat to rotate, and a control device controlling a rotating mode of the driving mechanism, wherein the driving mechanism is arranged in the box body;

wherein the holding seat comprises a U-shaped framework and a flexible mandrel arranged in the framework for sheathing the automatic winding watch; and two relative side plates of the framework are respectively formed with an elastic locking arm used for fixing the holding seat on the rotating seat;

wherein the tail end of the elastic locking arm towards the rotating seat is provided with a clamping bolt; and the rotating seat is provided with a clamping groove matched with the clamping bolt.

12. The automatic winding device used for automatic winding watch according to claim 11, wherein the rotating seat is circular, and the clamping groove is arranged on the internal side surface of the rotating seat; or, the rotating seat is tabular, and the clamping groove is arranged on the surface of the rotating seat facing to the holding seat.

13. The automatic winding device used for automatic winding watch according to claim 11, wherein the control device comprises a random number generation module for generating random parameters, a pulse duration modulation module matched with the random number generation module so as to generate the rotating mode, and a driving circuitry, wherein the rotating mode is a random rotating mode and the driving circuitry controls the driving mechanism to rotate according to the random rotating mode generated by the pulse duration modulation module.

14. The automatic winding device used for automatic winding watch according to claim 13, wherein the control device also comprises a control unit, and an optical sensor used for inducing a rotational velocity and a rotation angle of the driving mechanism, wherein the optical sensor, the random number generation module, the pulse duration modulation module and the driving circuitry are all electrically connected with the control unit.

15. The automatic winding device used for automatic winding watch according to claim 11, wherein the control device comprises a control unit, an optical sensor used for inducing the rotational velocity and rotation angle of the driving mechanism, a random number generation module for generating random parameters, a pulse duration modulation module matched with the random parameter generation module so as to generate a corresponding random rotating mode, and an H bridge driving circuitry, wherein the optical sensor, the random parameter generation module, the pulse duration modulation module and the driving circuitry are all electrically connected with the control unit.

* * * * *